US010151310B2

(12) United States Patent
Candiani

(10) Patent No.: US 10,151,310 B2
(45) Date of Patent: Dec. 11, 2018

(54) FLUID FLOW RATE MULTIPLIER

(71) Applicant: DES S.R.L., Sona (VR) (IT)

(72) Inventor: Massimo Candiani, Milan (IT)

(73) Assignee: DES S.R.L., Sona (VR) (IT)

( * ) Notice: Subject to any disclaimer, the term of this patent is extended or adjusted under 35 U.S.C. 154(b) by 0 days.

(21) Appl. No.: 15/234,648

(22) Filed: Aug. 11, 2016

(65) Prior Publication Data

US 2016/0348671 A1 Dec. 1, 2016

Related U.S. Application Data

(63) Continuation of application No. PCT/EP2015/077130, filed on Nov. 19, 2015.

(30) Foreign Application Priority Data

Nov. 21, 2014 (IT) ..... MI2014A2013

(51) Int. Cl.

| | |
|---|---|
| ***F04B 49/22*** | (2006.01) |
| ***F15B 3/00*** | (2006.01) |
| ***F04B 3/00*** | (2006.01) |
| ***F04B 7/02*** | (2006.01) |
| ***F04B 19/22*** | (2006.01) |

(Continued)

(52) U.S. Cl.

CPC ..... *F04B 49/22* (2013.01); *F04B 3/00* (2013.01); *F04B 7/02* (2013.01); *F04B 19/22* (2013.01); *F04B 53/10* (2013.01); *F04B 53/162* (2013.01); *F15B 3/00* (2013.01)

(58) Field of Classification Search

CPC .... F15B 11/036; F15B 11/0365; F15B 13/06; F15B 2211/7107; F15B 2211/7142; F15B 3/00; F04B 19/22; F04B 1/16; F04B 53/162; F04B 9/1096; F04B 9/113; F04B 9/115; F04B 49/22

USPC ..... 417/225, 383, 385, 386; 91/519, 533

See application file for complete search history.

(56) References Cited

U.S. PATENT DOCUMENTS 3,405,522 A 10/1968 Tomita
4,924,671 A * 5/1990 Reinert ..... B30B 15/16 417/265

(Continued)

FOREIGN PATENT DOCUMENTS

DE 267 466 11/1913
WO 2013/059430 4/2013

OTHER PUBLICATIONS

International Search Report issued in International Application PCT/EP2015/077130 dated Feb. 10, 2016.

(Continued)

*Primary Examiner* — Kenneth J Hansen
(74) *Attorney, Agent, or Firm* — Wenderoth, Lind & Ponack, L.L.P.

(57) ABSTRACT

A fluid flow rate multiplier including a pair of a first (1) and at least one second (2) watertight modules. Each of the modules having a first chamber (3) and at least one second (4) chamber. Both of the chambers include a piston (5, 6) configured to compress the fluid towards the bottom or the top of the chamber. The pistons are integral with each other along their axis (A), and the first and second modules are filled with the fluid. Moreover, the fluid flow rate multiplier includes a plurality of devices (10, 20, 30) adapted to introduce and to receive the fluid (FIG. 1).

13 Claims, 8 Drawing Sheets

(51) Int. Cl.
*F04B 53/10* (2006.01)
*F04B 53/16* (2006.01)

(56) References Cited

U.S. PATENT DOCUMENTS

2009/0317267 A1* 12/2009 Gill ..... F15B 3/00
417/53
2014/0161627 A1* 6/2014 Sivaramakrishnan .. F04B 1/128
417/2

OTHER PUBLICATIONS

Written Opinion of the International Searching Authority issued in International Application No. PCT/EP2015/077130 dated Feb. 10, 2016.

* cited by examiner

FLUID FLOW RATE MULTIPLIER

BACKGROUND OF THE INVENTION

1. Technical Field

The present invention relates to a fluid flow rate multiplier, in particular for oil.

2. Description of the Related Art

Devices adapted to ensure an oil flow rate for the operation of an end-user, e.g. a pump, are known in the prior art.

The devices usually have a low pressure oil input and output oil at higher pressure. The devices include electrically controlled means for increasing the output oil pressure.

WO2013/059430 describes a system for reducing and for controlling the pressure during underwater operations, e.g. during the extraction or transportation of liquid fuels. The system is provided with two chambers with one piston for each chamber.

Disadvantageously, said system does not allow the output fluid pressure to be increased, but only allows a decrease of the pressure during underwater operations.

In light of the described prior art, it is the object of the present invention to provide a fluid flow rate multiplier which is different from the know devices.

SUMMARY OF THE INVENTION

According to the present invention, such an object is reached by a fluid flow rate multiplier, characterized in that it comprises:

- a pair of a first and at least one second watertight module, each one comprising a first and at least one second chamber, the second chamber having a size multiple of the first chamber and both the chambers comprising a piston configured to press the fluid to the bottom or the top of the chamber, the pistons being integral with each other along their axis, both the first and second module being filled with fluid,
- first means adapted to introduce fluid into the first chamber of the first module and to receive fluid from the first chamber of the first module,
- second means adapted to allow the supply of fluid from at the least one second chamber of the first module into the first chamber of the second module and to allow the supply of fluid from the first chamber of the second module into the at the least one second chamber of the first module,
- third means adapted to allow the supply of fluid from at the least one second chamber of the second module to the end-user and to allow the supply of the fluid from the end-user towards the at the least one second chamber of the second module,
- control means for each module configured to detect the end of stroke of the piston of the first chamber of the single module and adapted to control the inflow of fluid into the first chamber from the top or the bottom of the chamber in response to the performed detection to allow the piston stroke towards the bottom of the first chamber or towards the top of the first chamber, respectively.

BRIEF DESCRIPTION OF THE DRAWINGS

The features and the advantages of the present invention will be apparent from the following detailed description of a practical embodiment thereof, illustrated by way of non-limiting example in the accompanying drawings, in which.

DETAILED DESCRIPTION OF THE INVENTION

Figure 1:
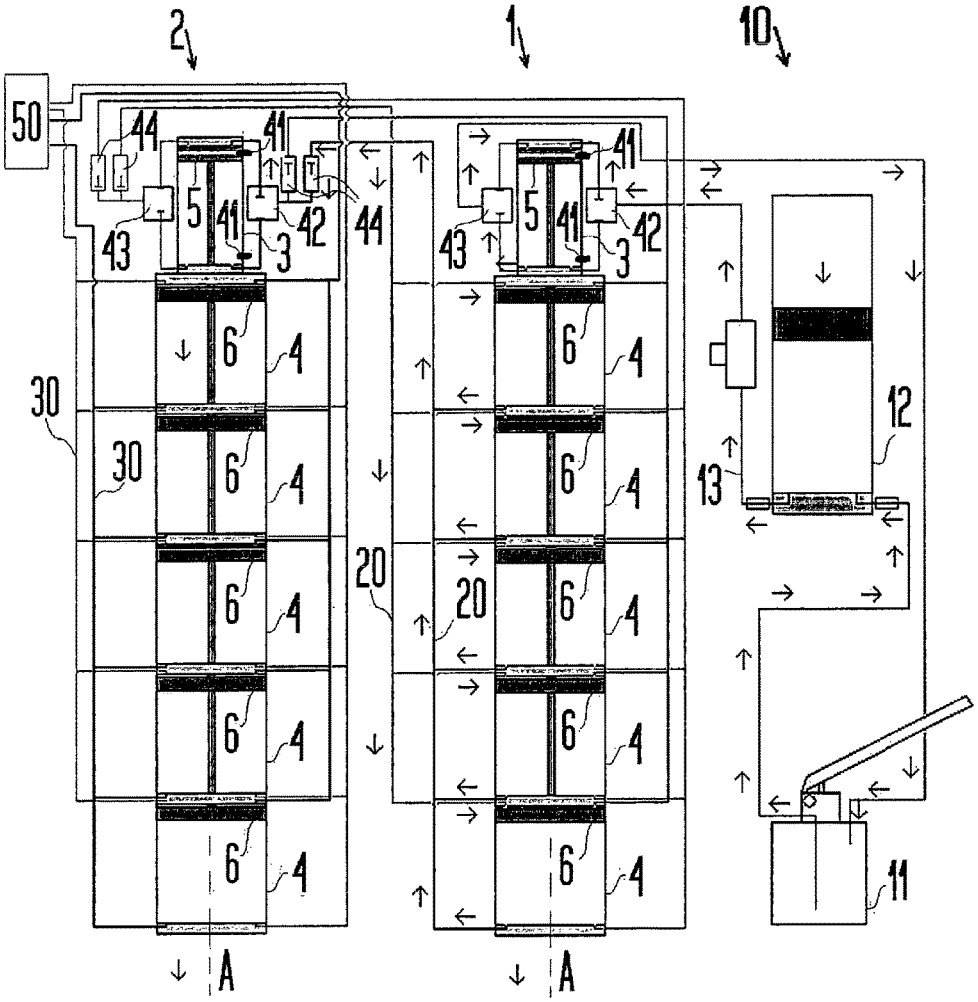
FIGS. 1-6 show various steps of operation of the fluid flow rate multiplier according to a first embodiment of the present invention.

FIGS. 1-6 show a fluid flow rate multiplier, in particular for oil, according to the present invention in the various steps of operation. The multiplier comprises a pair of a first 1 and at least one second 2 watertight modules; each module comprises a first chamber 3 and at least one second chamber 4, but preferably a plurality of second chambers 4. The first chamber 3 is smaller than the second chamber 4, in particular the second chamber having a size which is equal to a whole multiple of the first chamber, e.g. five. Both the first and the second module are filled with the fluid. The fluid in the following embodiments is oil but may also consist of chemical water or other fluid.

Both the first chamber 3 and the chamber 4 of the modules 1, 2 comprise respective pistons 5, 6 to compress the oil towards the bottom or towards the top of the chamber. The pistons 5, 6, of the dual-acting type, are integral with each other along their axis A, so that they can slide together either towards the bottom of the chambers 3, 4 or towards the top of the chambers 3, 4; the chambers 3 and 4 are closed and each have a central hole only for the passage of the stem of the pistons 5, 6.

Means 10 are provided adapted to introduce fluid into the first chamber 3 of the first module 1; said means are also adapted to receive oil from the first chamber of the first module. Said means may consist of an accumulator 12 and a device 11 connected to the accumulator 12 to introduce pressurized oil into the first chamber 3 of the first module 1 and tubular connection means 13 between the accumulator 12, the device 11 and the first chamber 3 of the first module 1; the device 11 receives oil from the chamber 3 of the first module. Preferably, oil is introduced by the means 10 at a pressure of approximately 100 bars.

Means 20 are provided adapted to allow the supply of oil from the second chamber 4 of the first module to the first chamber 3 of the second module 2 and to allow the supply of oil from the first chamber of the second module into the second chamber of the first module. Said means 20 are tubular connection pipes between the second chamber 4 of the first module and the first chamber 3 of the second module, in particular a pair of tubular pipes for the outflow of oil from the second chamber 4 of the first module and the inflow of oil into the first chamber 3 of the second module and a pair of tubular pipes for the inflow of oil into the second chamber 4 of the first module and the outflow of the oil from the first chamber 3 of the second module.

Means 30 are provided adapted to allow the supply of oil from the second chamber of the second module into the end-user 50 and to allow the supply of oil from the end-user towards the second chamber of the second module. Said means 30 are tubular connection pipes between the chamber 4 of the second module and the end-user 50, in particular a pair of tubular pipes for the outflow of oil from the second chamber 4 of the second module and the inflow of oil into the end-user 50 and a pair of tubular pipes for the inflow of oil into the second chamber 4 of the second module and the outflow of the oil from the end-user 50.

Control means 41-44 are provided adapted to detect the end of piston stroke and are adapted to control the piston stroke towards the bottom of the first chamber or towards the top of the first chamber by means of the inflow of oil into the first chamber from the top or from the bottom of the chamber according to the performed detection, respectively. In other words, the pistons 5, 6 of the first and of the second chamber of the second module perform a multiple stroke with respect to the pistons of the first and second chamber of the first module guaranteeing an output oil flow from the second chamber which is a multiple of the input oil flow into the first chamber of the first module.

Said control means comprise piston stroke end detectors 41 of the piston 5 arranged on the bottom and the top of the first chamber, valves 42 for the inflow into the first chamber and valves 43 for the outflow of oil from the first chamber and valves 44 for closing the tubular pipes 20 present only in the at least one second module 2. The valves 42 (in combination with the valves 44 only for the at least one second module 2) control the inflow of oil into the first chamber from the top or from the bottom of the chamber, while the valves 43 (in combination with the valves 44 only for the at least one second module 2) control the respective outflow of oil from the first chamber from the bottom or from the top of the chamber; the valves 42 are controlled by the stroke end detectors 41.

FIGS. 1-6 show a flow rate multiplier according to an embodiment of the present invention, in which both the first module 1 and the second module 2 comprise a plurality, e.g. five, of second chambers 4 having the same size, i.e. every second chamber has a size which is five times that of the first chamber 3; however, the second chambers 4 could have mutually different sizes and the second chambers of the first and of the second module may be different in number. All the second chambers 4 of the first module introduce oil into the first chamber 3 of the second module and receive oil from the same first chamber, while all the second chambers 4 of the second module 2 introduce oil into the end-user 50 and receive oil therefrom.

Figure 2:
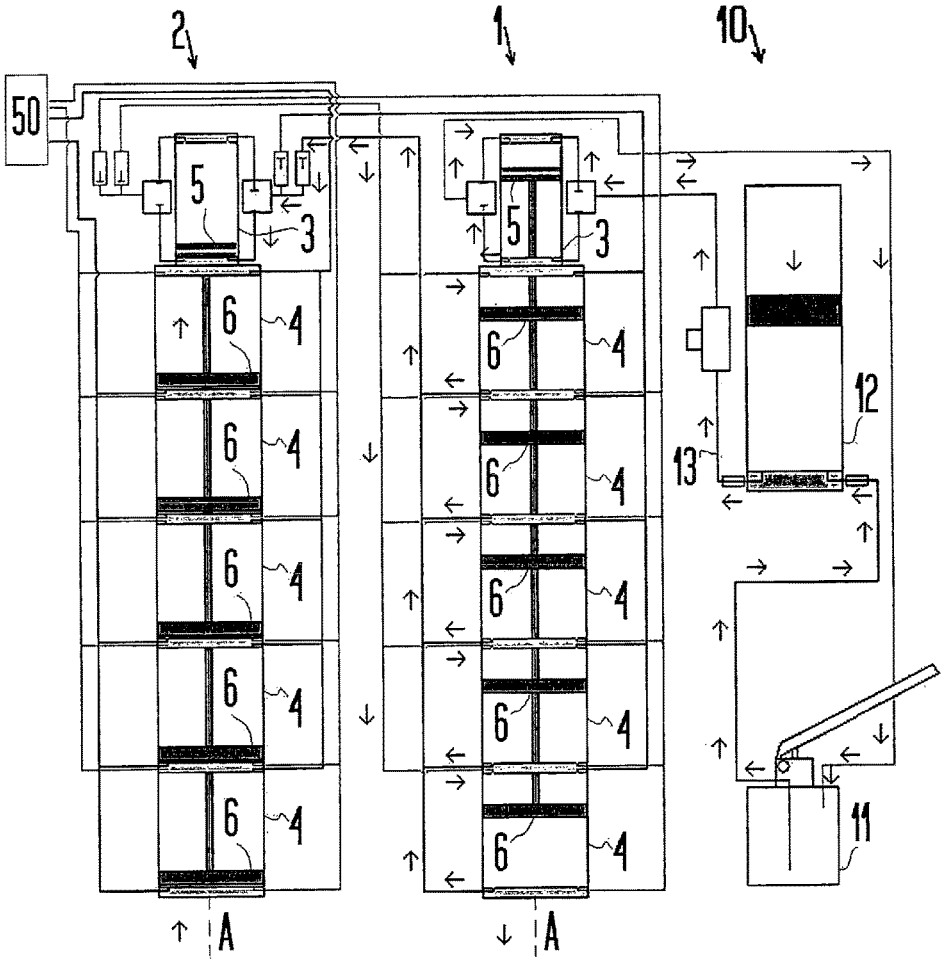

FIG. 2 shows the initial step in which the oil coming from the means 10 is forced in input into the first chamber 3 of the first module 1 and pushes the piston 5 towards the bottom of the chamber; in such a manner, the piston 6 of the second chamber 4, integral with the piston 5 is pushed towards the bottom of the chamber. The oil exiting from the second chambers 4 of the first module is introduced into the first chamber 3 of the second module 2 by means of one of the two tubular pipes and outflows from the first chamber 3 of the second module towards the second chambers 4 of the first module by means of one of the two tubular pipes, as indicated by the arrows in FIG. 2.

In particular, it can be noted in FIG. 2 that, when the pistons 5, 6 of chambers 3, 4 of the first module have traveled a distance which is approximately 1/25th of the total length of the respective chambers, the pistons 5, 6 of the chambers 3, 4 of the second module have already reached the bottom of the chambers. The piston stroke end detectors 41 of the chamber 3 of the second module control the valves 42 for the introduction of oil from the bottom of the chambers 3, 4 of the second module by reversing the stroke of the pistons 5, 6 (FIG. 2).

Figure 3:
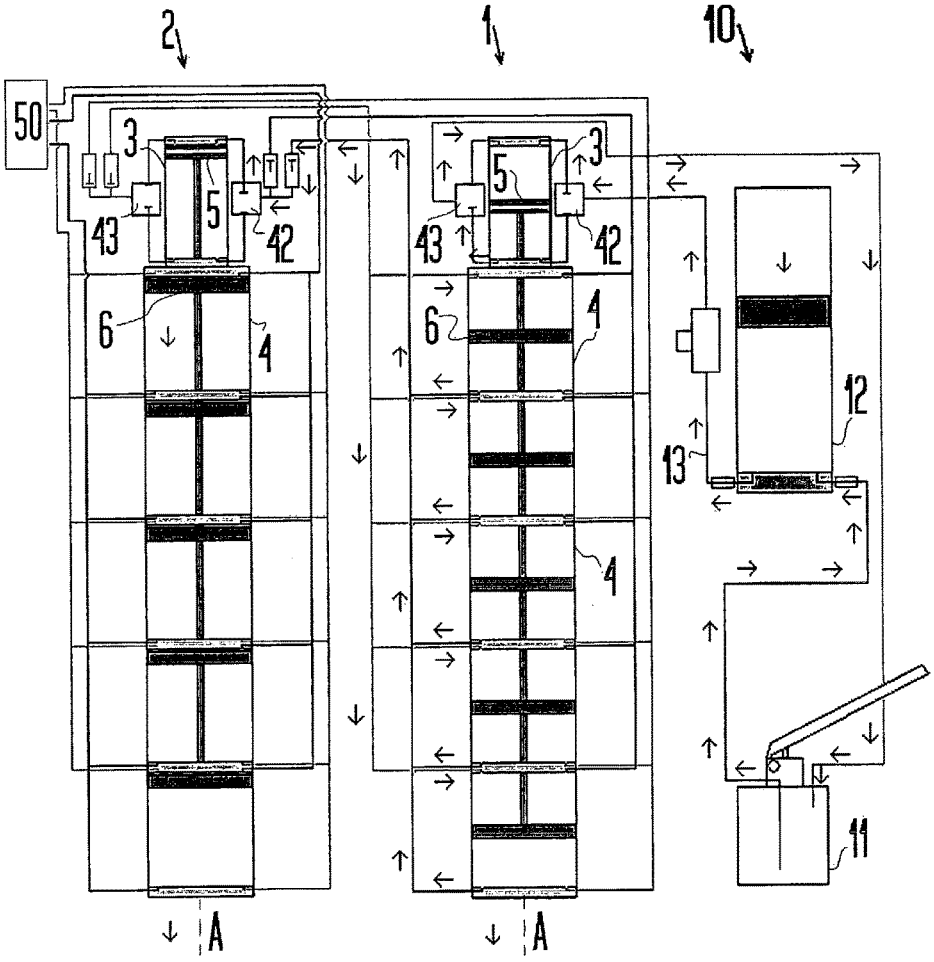

When the pistons 5, 6 of chambers 3, 4 of the first module have traveled a distance which is approximately 10/25th of the total length of the respective chambers, the pistons 5, 6 of the chambers 3, 4 of the second module have already reached at the top of the chambers. The piston stroke end detectors 41 of the chamber 3 of the second module control the valves 42 for introducing oil from the top of the chambers 3, 4 of the second module by reversing the stroke of the pistons 5, 6 (FIG. 3).

Figure 4:
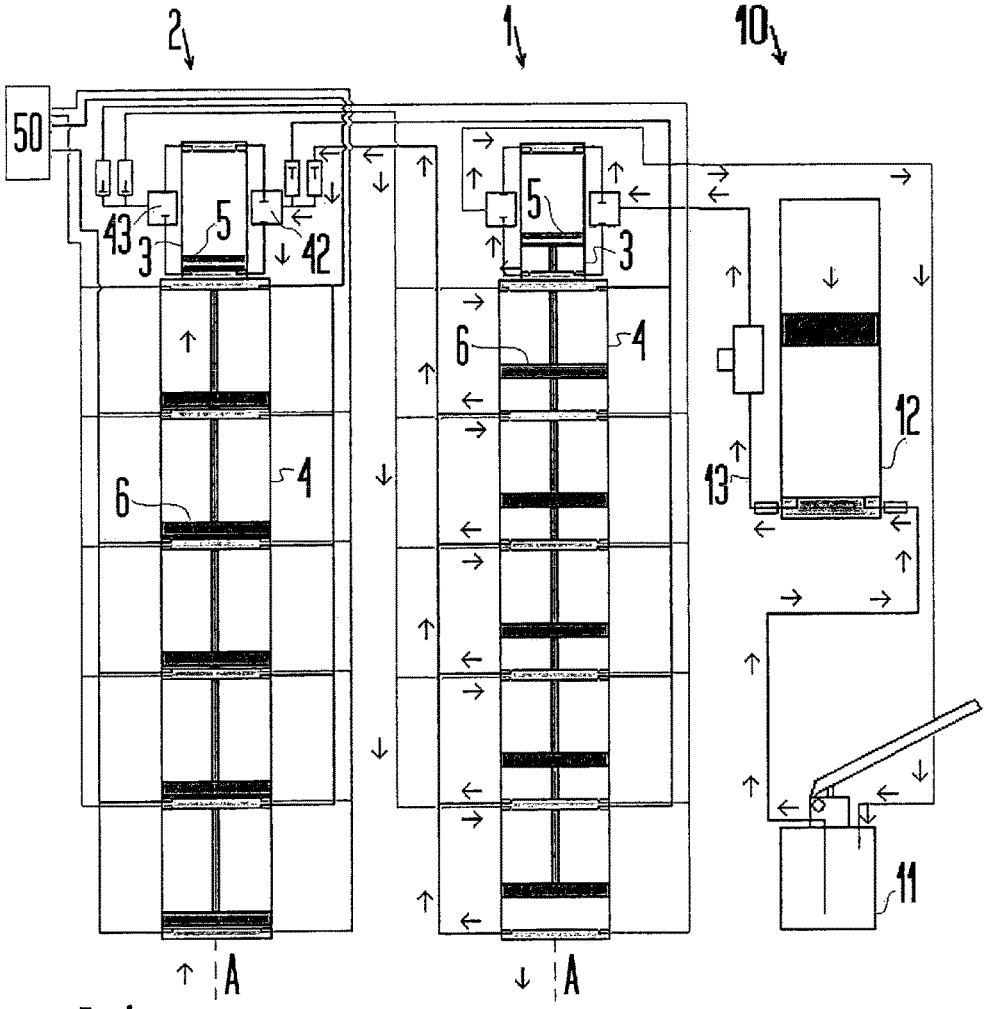

When the pistons 5, 6 of chambers 3, 4 of the first module have traveled a distance which is approximately 19/25th of the total length of the respective chambers, the pistons 5, 6 of the chambers 3, 4 of the second module have already reached the bottom of the chambers. The piston stroke end detectors 41 of the chamber 3 of the second module control the valves 42 for introducing oil from the bottom of the chambers 3, 4 of the second module by reversing the stroke of the pistons 5, 6 (FIG. 4).

Figure 5:
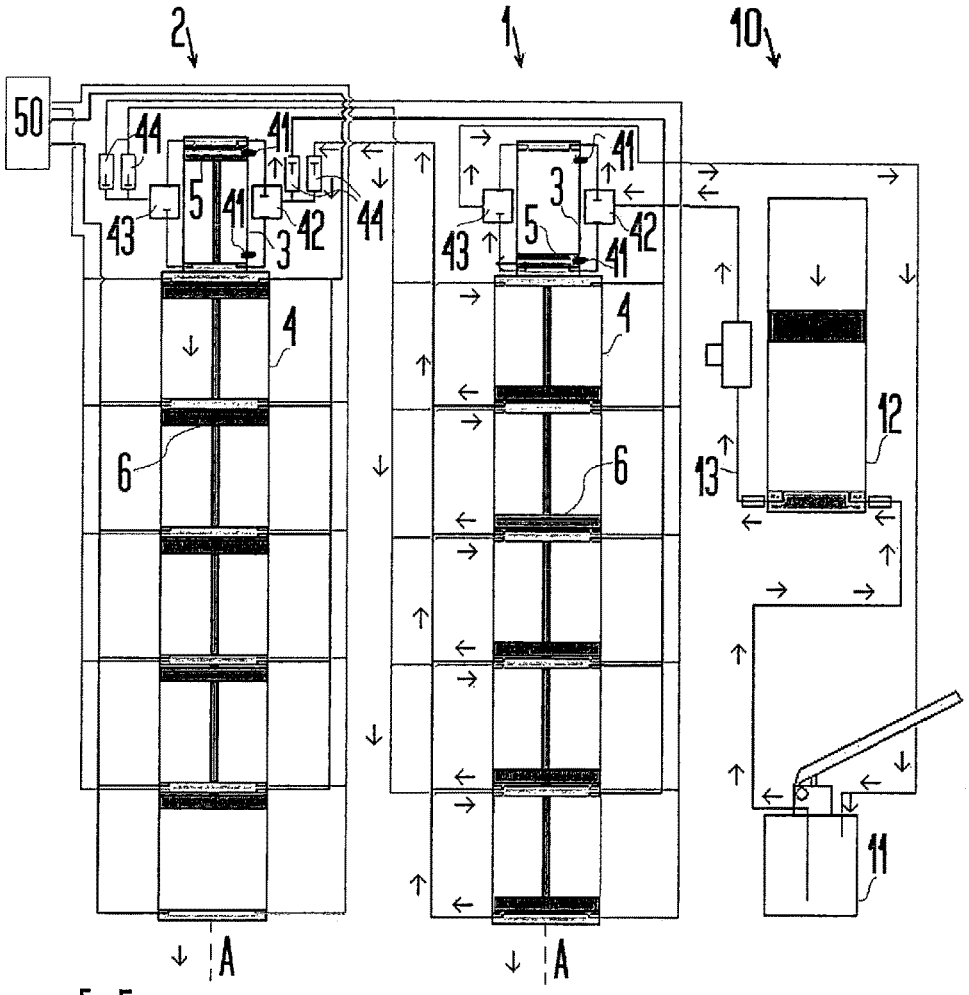

When the pistons 5, 6 of chambers 3, 4 of the first module reach the bottom of the respective chambers, the pistons 5, 6 of the chambers 3, 4 of the second module have already reached the top of the chambers. The stroke end detectors 41 of the chamber 3 of the first module control the valves 42 for introducing oil from the bottom of the chambers 3, 4 of the first module for reversing the stroke of the pistons 5, 6, while the stroke end detectors 41 of the chamber 3 of the second module control the valves 42 for introducing oil from the top of the chambers 3, 4 of the second module by reversing the stroke of the pistons 5, 6 (FIG. 5). The oil exiting from the second chambers 4 of the first module is introduced into the first chamber 3 of the second module 2 by means of the same tubular pipe and outflows from the first chamber 3 of the second module towards the second chambers 4 of the first module by means the same tubular pipe, as indicated by the arrows in FIGS. 1-5.

Figure 6:
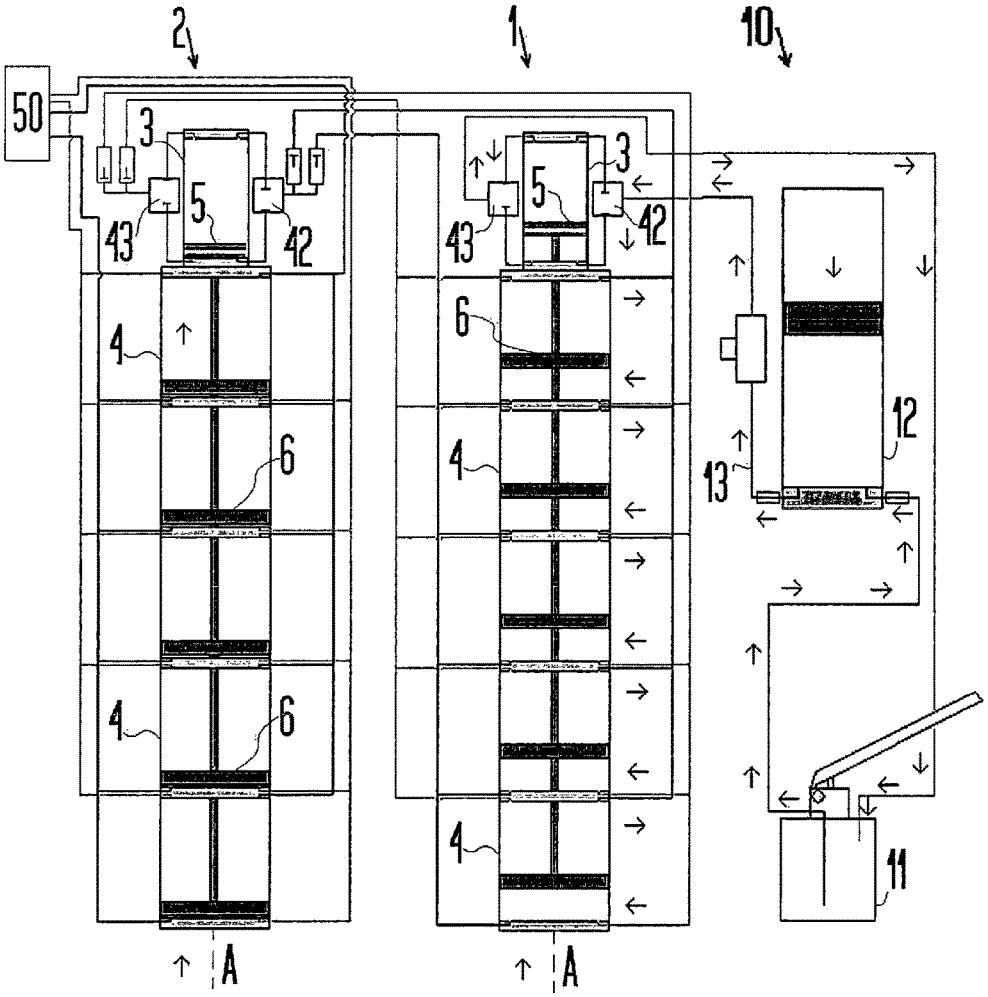

When the pistons 5, 6 of chambers 3, 4 of the first module have traveled a distance which is approximately 10/25th of the total length of the respective chambers, the pistons 5, 6 of the chambers 3, 4 of the second module have already reached the bottom of the chambers. The stroke end detectors 41 of the chamber 3 of the second module control the valves 42 for introducing oil from the bottom of the chambers 3, 4 of the second module by reversing the stroke of the pistons 5, 6 (FIG. 6). The oil exiting from the second chambers 4 of the first module is introduced into the first chamber 3 of the second module 2 by means of the other of the two tubular pipes and outflows from the first chamber 3 of the second module towards the second chambers 4 of the first module by means of the other of the two tubular pipes, as indicated by the arrows in FIG. 6.

FIGS. 1-6 show that a complete stroke of the pistons 5, 6 of the chambers 3, 4 of the first module corresponds to twenty-five strokes of the piston 5, 6 of the chambers 3, 4 of the second module; in such a manner, there is an oil flow rate equal to twenty-five time the input oil flow rate at the multiplier outlet.

Figure 7:
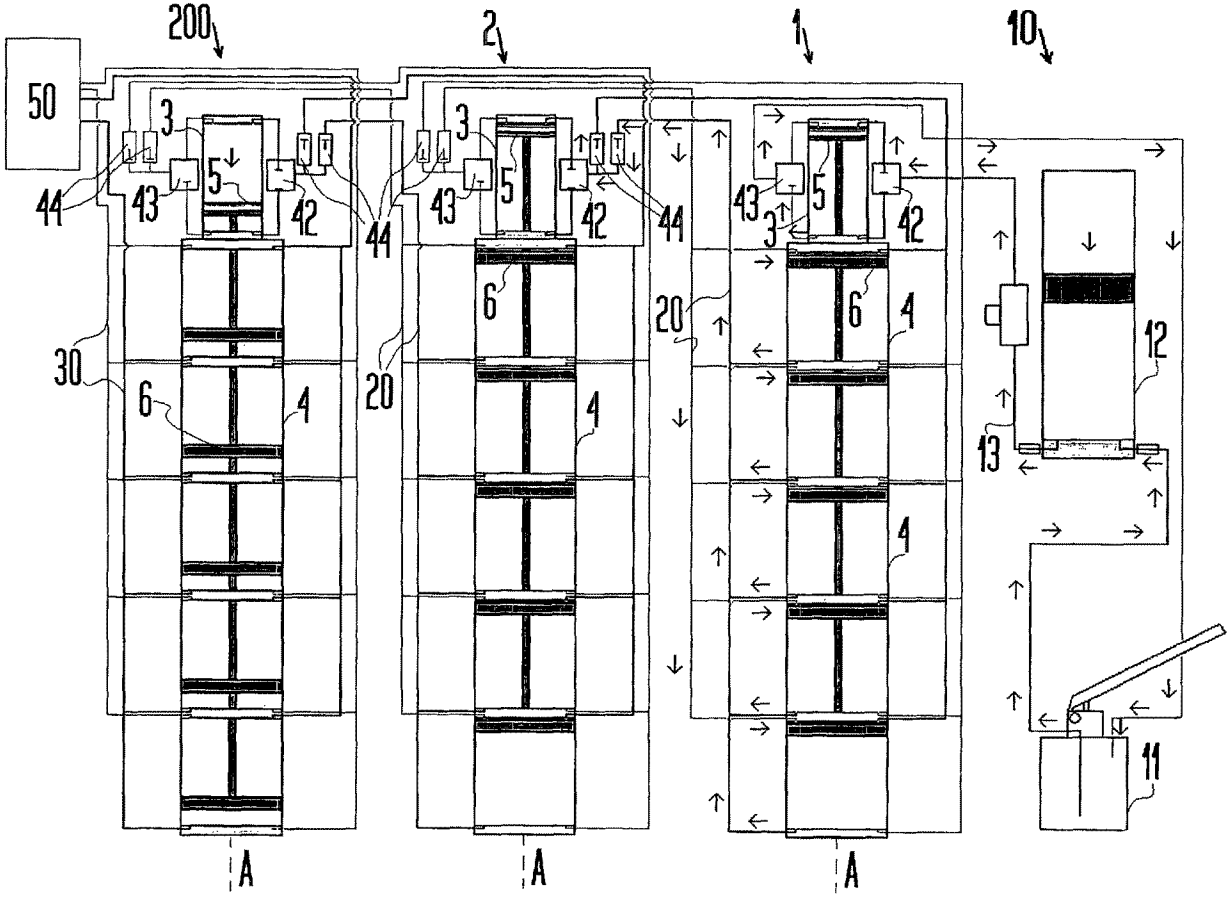
FIG. 7 shows a fluid flow rate multiplier according to a variant of the embodiment of the present invention.

According to a variant of the embodiment of the present invention, the oil flow rate multiplier may comprise a further second module 200 which is entirely similar to the second module 2 and arranged between the second module 2 and the end-user 50, as shown in FIG. 7; in such a case, the further second module 200, in particular the chamber 3, receives from the chambers 4 of the second module 2 the oil for actuating the piston 5 and supplies oil to the same chambers 4 of the second module 2 by means of further means similar to the means 20. The chambers 4 of the second module 200 supply oil to the end-user 50 and receive oil from the same end-user 50 by means of the means 30. A complete stroke of the pistons 5, 6 of the chambers 3, 4 of the second module 2 corresponds to twenty-five strokes of the pistons 5, 6 of the chambers 3, 4 of the second module 200; in such a manner, there is an oil flow rate equal to six-hundred twenty-five times the input oil flow rate at the multiplier outlet. The second chambers 4 of the module 200 may also have different sizes from the second chambers 4 of the module 2 and the second chambers of the module 2 and of the module 200 may be different in number.

Figure 8:
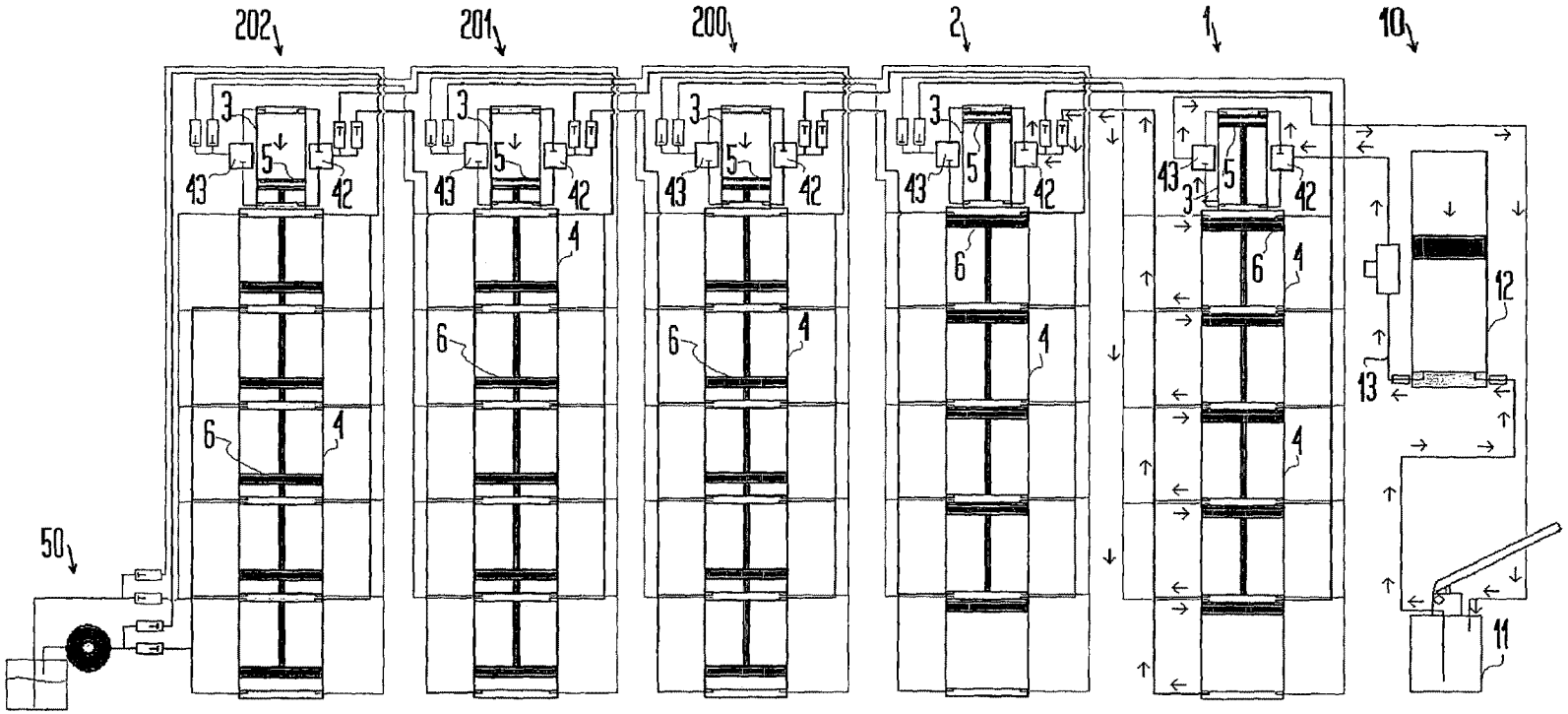
FIG. 8 shows a fluid flow rate multiplier according to another variant of the embodiment of the present invention.

According to another variant of the embodiment of the present invention, the oil flow rate multiplier may comprise three second modules 200, 201, 202 entirely similar to the second module 2 and arranged between the second module 2 and the end-user 50, as shown in FIG. 8; in such a case, the second module 200, in particular the chamber 3 receives from the chambers 4 of the second module 2 the oil for actuating the piston 5 and supplies oil to the same chambers 4 of the second module 2 by means of further means similar to the means 20. The chambers 4 of the second module 200 supply oil to the chamber 3 of the second module 201 and receive oil from the same by means of further means similar to the means 20. The second module 201, in particular the chamber 3, receives from the chambers 4 of the second module 200 the oil for actuating the piston 5 and supplies oil to the same chambers 4 of the second module 200 again by means of further means similar to the means 20.

The chambers 4 of the second module 201 supply oil to the chamber 3 of the second module 202 and receive oil from the same again by means of further means similar to the means 20. The chambers 4 of the second module 202 supply oil to the end-user 50 and receive oil from the end-user 50 itself by means of the means 30. A complete stroke of the pistons 5, 6 of the chambers 3, 4 of the second module 200 corresponds to twenty-five strokes of the pistons 5, 6 and of the chambers 3, 4 of the second module 201 and a complete stroke of the pistons 5, 6 of the chambers 3, 4 of the second module 201 corresponds to twenty-five strokes of the pistons 5, 6 of the chambers 3, 4 of the second module 202; in such a manner, there is an oil flow rate equal to 25×25×625 times the input oil flow rate at the multiplier outlet. The second chambers 4 of the modules 200-202 may also have different sizes and be different in number.

In other words, every additional second module in the flow rate multiplier according to the present invention contributes to increasing the output oil flow rate.

The efficiency of the multiplier will be lower as a function of the friction.

The fluid used in one module between the first module and the second module or used in multiple modules between the first module and the plurality of second modules may be different from the fluid used in the other module or modules.

The end-user 50 could be a rotary pump (as shown in FIG. 8) or a hydraulic pump or a hydraulic turbine for transforming the oil flow into rotation and to be able to connect an electric motor, a piston pump, a pump for pumping a cooling/heating fluid in a closed circuit or a piston for using the axial motion produced by the last second module.

Example 1

Test with Only One Module and Three Pistons

| | |
|---|---|
| NET VOLUME OF THE PISTON (liters) | 1.022 |
| NUMBER OF PISTONS | 3 |
| GLOBAL OUTPUT BARS | 19.400 |
| NUMBER OF MACHINE CYCLES | 10.159 |
| OUTPUT LITERS | 30.751 |
| OUTPUT WATTS | 117.629 |

The first test was performed with one single module to evaluate the output liters of fluid and the generated watts. Three pistons are used with a volume of 1.022 liters each for approximately 10 machine cycles.

Example 2

Test with Only One Module and Two Pistons

| | |
|---|---|
| NET VOLUME OF THE PISTON (liters) | 1.022 |
| NUMBER OF PISTONS | 2 |
| GLOBAL OUTPUT BARS | 28 |
| NUMBER OF MACHINE CYCLES | 6.676 |
| OUTPUT LITERS | 13.162 |
| OUTPUT WATTS | 231.898 |

The second test was performed with only one module to evaluate the output liters of fluid and the generated watts. Two pistons with a volume of 1.022 liters each was used for approximately 7 machine cycles.

The invention claimed is:

1. A fluid flow rate multiplier comprising:

a first watertight module and at least one second watertight module, each of the first and second modules comprising a first chamber and at least one second chamber, the second chamber having a size multiple of the first chamber and both the first and second chambers comprising a piston configured to press the fluid to a bottom or a top of the respective chamber, the pistons being integrally connected with each other along a common axis (A), both the first and second modules being filled with fluid;

first means for supplying fluid into the first chamber of the first module and receiving fluid from the first chamber of the first module;

second means for supplying fluid from the second chamber of the first module into the first chamber of the second module and to outflow fluid from the first chamber of the second module into the second chamber of the first module;

third means for supplying fluid from the second chamber of the second module to an end-user and outflowing fluid from the end-user into the second chamber of the second module; and control means for each of the first and second modules, the control means being configured to detect an end of a stroke of the piston of the first chamber of the first module and configured to control the supply of fluid into the first chamber from a top or a bottom of the first chamber in response to detection of the stroke end to respectively allow the piston stroke towards the bottom or the top of the first chamber.

2. The fluid flow rate multiplier according to claim 1, wherein the control means comprises a pair of piston stroke end detectors arranged on the bottom and the top of the first chamber of each of the first and second modules and valves to regulate fluid flow from the top or the bottom of the respective first chamber in response to piston stroke end detection at the top or the bottom of the respective first chamber.

3. The fluid flow rate multiplier according to claim 1, wherein each of the first and second modules comprises a plurality of the second chambers, the second means being adapted to allow the supply of fluid from the plurality of second chambers of the first module into the first chamber of the second module and the supply of fluid from the first chamber of the second module into the plurality of second chambers of the first module, the third means being adapted to allow the supply of fluid from the plurality of second chambers of the second module into the end-user and the supply of fluid from the end-user into the plurality of second chambers of the second module.

4. The fluid flow rate multiplier according to claim 3, wherein the second chambers of the first and second modules are of equal size.

5. The fluid flow rate multiplier according to claim 3, wherein at least one of the second chambers of the first module is a whole multiple of times greater than the size of the first chamber of the first module.

6. The fluid flow rate multiplier according to claim 3, wherein the second chambers of the first module are equal in number to the second chambers of the second module.

7. The fluid flow rate multiplier according to claim 1, further comprising a plurality of second modules arranged so that each first chamber of the plurality of the second modules is in fluid flow connection with the second chamber of the first module by means of the second means, the at least one second chamber of a last module of the plurality of second modules is in fluid flow connection with the end-user by means of the third means and every other second module of the plurality of second modules has the first chamber in fluid flow connection with the second chamber of a preceding module of the plurality of second modules and the at least one second chamber in fluid flow connection with the first chamber of the successive module of the plurality of second modules by means of further means adapted to supply fluid from the second chamber of a preceding module of the plurality of second modules into the first chamber of the successive module of the plurality of second modules.

8. The fluid flow rate multiplier according to claim 1, wherein the end-user is a pump.

9. The fluid flow rate multiplier according to claim 1, wherein the fluid is oil.

10. The fluid flow rate multiplier according to claim 1, wherein the fluid used in one of the first and second modules is different from the fluid used in the other of the first and second modules.

11. A fluid flow rate multiplier comprising:

a first watertight module;

at least one second watertight module, each of the first and second modules comprising a first chamber and at least one second chamber, the at least one second chamber having a size multiple of the first chamber and both the first and second chambers including a piston configured to press fluid to a bottom or a top of the respective chamber, wherein the pistons in each of the first and second modules are integrally connected to each other along a common axis (A), and both of the first and second modules are filled with fluid;

an accumulator fluidly connected to the first chamber of the first module;

a first connection pipe for receiving an outflow of fluid from the second chamber of the first module and supplying the fluid to the first chamber of the second module;

a second connection pipe for receiving an outflow of fluid from the first chamber of the second module and supplying the fluid to the second chamber of the first module;

a third connection pipe for receiving fluid from the second chamber of the second module and supplying the fluid to an end-user;

a fourth connection pipe for receiving an outflow of fluid from the end-user and supplying the fluid to the second chamber of the second module;

a pair of piston stroke end detectors arranged on the bottom and the top of the first chamber of each of the first and second modules;

a first valve for controlling inflow of fluid flow into the first chamber of the first module;

a second valve for controlling outflow of fluid flow from the first chamber of the first module;

a third valve for controlling inflow of fluid flow into the first chamber of the second module; and a fourth valve for controlling outflow of fluid flow from the first chamber of the second module, wherein the first, second, third and fourth valves are operable in response to piston stroke end detections by the piston stroke end detectors of the respective first chambers of the first and second modules.

12. The fluid flow rate multiplier according to claim 11, wherein the second chamber of the first module and the second chamber of the second module are of equal size.

13. The fluid flow rate multiplier according to claim 11, wherein the size of the second chamber of the first module is a whole multiple of times greater than the size of the first chamber of the first module.

* * * * *